United States Patent [19]

Heinz

[11] Patent Number: 4,565,004

[45] Date of Patent: Jan. 21, 1986

[54] STAINED GLASS WINDOW CONSTRUCTING TOOL

[76] Inventor: Peter G. Heinz, 22754 Ventura Blvd., Woodland Hills, Calif. 91364

[21] Appl. No.: 592,735

[22] Filed: Mar. 22, 1984

Related U.S. Application Data

[63] Continuation of Ser. No. 333,643, Dec. 23, 1981, abandoned.

[51] Int. Cl.[4] ..... B26B 3/00

[52] U.S. Cl. ..... 30/314; 30/342; 30/353; 7/105

[58] Field of Search ..... 30/294, 314, 342, 343, 30/344, 353, 346; 7/158, 105

[56] References Cited

U.S. PATENT DOCUMENTS

| | | | |
|---|---|---|---|
| 80,242 | 7/1868 | Tongue | 30/353 X |
| 164,880 | 6/1875 | Shelton | 30/314 |
| 527,859 | 10/1894 | Ingram | 30/353 X |
| 576,501 | 2/1897 | Talley | 30/314 X |
| 745,162 | 11/1903 | Donnelly | 30/353 |
| 1,500,402 | 7/1924 | Lewis | 30/317 X |
| 1,703,305 | 2/1929 | Jenkins | 30/314 X |
| 2,023,269 | 12/1935 | Edgren | 30/317 |
| 2,116,852 | 5/1938 | Stanford | 30/353 X |
| 2,597,258 | 5/1952 | Papp | 30/342 X |
| 2,743,524 | 5/1956 | Doniger | 30/342 |
| 3,187,354 | 6/1965 | Frisbie | 7/158 |
| 3,321,783 | 5/1967 | Ivan | 7/158 |
| 3,462,780 | 8/1969 | Greco | 7/158 |

FOREIGN PATENT DOCUMENTS

| | | | |
|---|---|---|---|
| 883672 | 10/1971 | Canada | 7/158 |

*Primary Examiner*—Jimmy C. Peters

*Attorney, Agent, or Firm*—Spensley Horn Jubas & Lubitz

[57] ABSTRACT

A multipurpose tool useful in the construction of stained glass windows is described. The tool comprises a stiff, short blade having a curved cutting portion which sweeps around the end. The blade is provided with a short frusto-conically shaped handled which, in the preferred embodiment, comprises an inner core portion fabricated preferably of a heavy material and an outer sleeve portion fabricated preferably of wood, plastic or hard rubber. When used as a knife to cut lead came, the short construction of the present invention permits the end of the handle to be placed in the palm of the hand with the thumb and fingers placed generally parallel to the length of the handle along the sides of the handle as well as on the sides and back of the blade. This permits the entire strength of the arm, rather than merely the wrist, to be used for cutting the lead came, while permitting the hand to be still placed close to the lead channel being cut so that precise control over the tool can be maintained. The inner core portion of the handle is exposed at the end of the handle opposite to the blade so as to be useable for hammering nails into the work surface on which the stained glass window is being constructed. The end of the sleeve portion at the end of the handle opposite the blade is used for tapping on the edges of stained glass pieces in order to position them tightly within right came channels. Opposite the cutting end, the blade of the tool has a noncutting edge which is concave in shape, and which can be used to remove nails from the work surface upon which the stained glass window is being constructed by pivoting the tool about the cutting portion of the blade.

10 Claims, 4 Drawing Figures

STAINED GLASS WINDOW CONSTRUCTING TOOL

This application is a continuation of Ser. No. 333,643, filed Dec. 23, 1981, now abandoned.

BACKGROUND OF THE INVENTION

1. Field of the Invention

This invention relates to the field of tools used in constructing stained glass windows.

2. Prior Art

Many different tools have been used in stained glass window construction. For example, knives have been used for centuries to cut the lead came or channels which are used between the pieces of the stained glass in stained glass windows and around the periphery of stained glass windows. The prior art knives comprise a blade having a large cutting edge and a handle which is grasped by encircling it more or less circumferentially with the fingers and the thumb. The lead is cut by applying the pressure on the knife with the wrist and rocking and wiggling the knife until the lead came is cut through.

Other tools are also used for cutting lead came. Such tools include dykes, apparatuses comprising a razor blade held in a bracket and electrical machines.

During the construction of a stained glass window, nails are continually hammered in and removed in order to hold the pieces of lead and glass in their proper positions on the work surface as the construction of the window proceeds. This requires the use of a tool which can perform the function of a hammer. In fact, a conventional small hammer is often used, although knives having handles whose ends are made of metal have also been known to be used to hammer in the nails. Typically, hammers or pliers are used to remove the nails.

In order to fit the pieces of stained glass tightly into the lead came channels, the pieces of glass are tapped along their edges. Normally this is done by means of a lathkin and a hammer. The lathkin is a small piece of wood, one end of which is placed against the edge of the glass to be tapped. A hammer is used to tap on the other end of the piece of wood. This avoids any direct contact of a metal hammer with the edge of the glass and is done in order to minimize the possibility of the glass breaking. The lathkin, however, requires the use of two hands, one hand to position the lathkin and the other hand to wield the hammer. At best, it is inconvenient to also attempt to hold in place the piece of glass to be tapped.

It will be appreciated, therefore, that the work space may become somewhat cluttered with the array of tools necessary, prior to the present invention, in stained glass window construction. On the other hand, the present invention, which comprises a tool for cutting lead as well as incorporates features which allow other operations necessary in the construction of stained glass windows to be performed, can, alone, replace all the tools described above. In addition, the present invention can perform the lead cutting and glass tapping operations in a manner superior to that possible using the heretofore existing instruments and techniques.

SUMMARY OF THE INVENTION

The present invention concerns a uniquely configured tool which allows lead came used in stained glass window construction to be cut in a cleaner fashion and with more ease than has heretofore been possible with a knife-type tool. A significant advantage is also obtained using the present invention to tap the pieces of stained glass tightly into position in the lead came channels during the construction procedure, as a single tool replaces the hammer and lathkin previously used. Thus, one hand is now freed in order to hold the stained glass piece in its proper position as the glass is tapped. In addition to the advantages provided by the present invention for the two above-described functions, the present invention can be conveniently used to hammer in and remove from the work surface on which the stained glass window is being constructed the nails that are used to properly position the lead came and the pieces of glass during the construction of a stained glass window.

The present invention comprises a stiff, short blade having a curved cutting portion which sweeps around the end. The blade is provided with a short frusto-conically shaped handle. When used as a knife, the end of the handle is placed in the palm of the hand with the thumb and fingers placed generally parallel to the length of the handle along the sides of the handle as well as on the sides and the back safet edge of the blade. In use, the tool is held essentially upright, but because of the shortness of the handle and blade, the hand is still placed close to the working surface so that precise control over the tool is maintained.

With the prior art knives used for cutting lead came, the handle is grasped by the palm of the hand and the fingers are extended generally circumferentially around the handle to grasp it. The side of the blade is typically used so that the knife forms an acute angle with respect to the working surface. A downward force originating with the wrist and the hand is used to cut the lead came.

With the present invention, the handle and the knife blade are aligned with the entire arm, so that the arm, rather than the hand and wrist, can be used to exert the force necessary to cut through the lead came. This significantly eases the effort required to cut through the lead came.

The handle of the present invention comprises an inner core portion which is fabricated preferably of a heavy metal and an outer replaceable sleeve portion which is fabricated preferably of wood, plastic or hard rubber. The inner core portion is not covered at the end of the handle opposite to the blade, but is left exposed so as to be usable for hammering nails into the work surface upon which the stained glass window is being constructed. The outer sleeve portion extends as far as or slightly beyond the inner core portion on the end of the handle opposite to that to which the blade is attached. The end of the sleeve portion, therefore, may be used during the construction of a stained glass window to tap directly on the edges of stained glass pieces in order to position them tightly within the lead channels. Because the sleeve portion is of a softer material, such as wood, the possibility of breaking the stained glass pieces is reduced while the inner core portion provides the weight necessary for tapping the glass pieces or hammering nails.

The blade of the present invention can be used to remove nails which have been partially hammered into the work surface. As has been mentioned, these nails are used to hold the lead came and stained glass pieces in position during the construction of a stained glass window, and therefore are hammered in only partially. In order to assist in removing these nails, the blase has a noncutting edge which is concave in shape. The end of the blade terminates in a flat tip rather than a point which not only gives the blade more strength at its end for cutting, but also allows the end to be safely used to remove nails. To remove a nail, the cutting edge of the blade of the tool is placed on the working surface with the non-cutting concave edge placed, near the tip, beneath the head of the nail. The tool is then pivoted on the blade by pushing the handle downward thereby raising the tip of the blade and the nail. Since the work surface is typically wood or plywood, no real damage ensues to either the work surface or the cutting edge of the blade.

The present invention, thus, provides not only an improved knife for cutting lead came, but a tool which allows many other common operations that are performed during the construction of stained glass windows to be performed with the same tool. By combining the capability for performing a number of functions into one tool, the clutter of the area in which the stained glass window is being fabricated is reduced. This provides not only a safer working area for both the relatively fragile stained glass pieces and the craftsman, but also enhances the efficiency of the construction procedure.

The novel features which are believed to be characteristic of the present invention, both as to its organization and as to its methods of operation, together with further objectives and advantages thereof will be better understood from the following description, considered in connection with the accompanying drawing, in which a presently preferred embodiment of the invention is illustrated by way of example. It is expressly understood, however, that the description of the preferred embodiment and the drawings are for the purpose of illustration and description only, and are not intended as a definition of the limits of the invention.

DESCRIPTION OF THE PREFERRED EMBODIMENT

The present invention is a combination tool especially suitable for use in stained glass window construction. The particular structure of the tool enables it to be used as a knife to cut the lead came that is placed between and around the glass pieces forming the stained glass window in a manner which allows the entire arm, rather than merely the wrist and hand, to be applied to the cutting operation. In addition, the tool of the present invention allows a number of other operations routinely performed in stained glass window making to be performed more effectively and/or efficiently.

Figure 1:
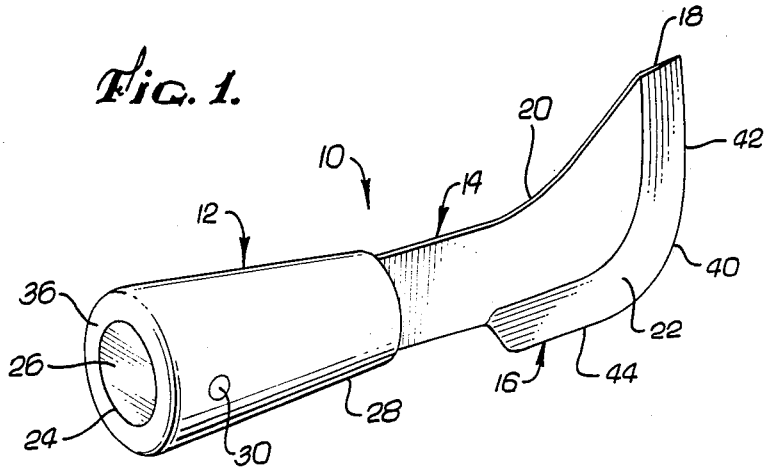
FIG. 1 is a perspective view of a preferred embodiment of the present invention.

The general configuration of the tool of the present invention can be seen in FIG. 1. The tool 10 comprises a handle portion 12 and a blade portion 14. The blade 14 is preferably formed of heat-treated high carbon steel. Its cutting edge 16 is arcuate, forming an essentially rounded corner across the end of the blade. The portion of the cutting edge 16 which lies closest to the handle 12 runs generally parallel to the length of the blade 14 and handle 12, curving around the end of the blade 14 past the center line of the knife and terminating in a tip 18 at which position the cutting edge 16 is approximately perpendicular to the center line of the tool 10.

The non-cutting edge 20 of the blade 14 is generally concave in shape. The tip 18 of the blade 14 is flat rather than sharp or pointed. This gives the blade 14 greater stiffness in the region near the tip 18 so that the cutting edge 16 near the tip 18 may be used to cut lead in tight corners, such as where it is desired to fit two pieces of lead came together at a corner of a stained glass piece.

The stiffness provided by having a flat tip 18 also enables the portion of the non-cutting edge 20 immediately adjacent to the tip 18 to be placed beneath the head of a nail in order to remove it from the working surface as will be described.

Figure 4:
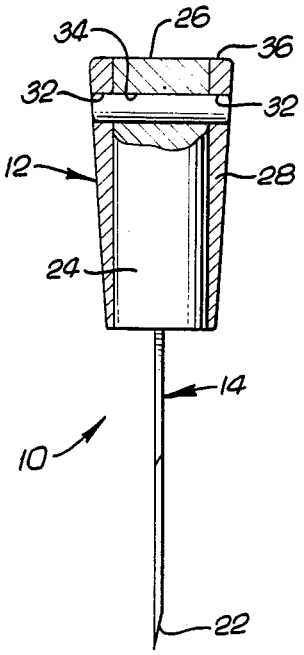
FIG. 4 is a cross-sectional view of the present invention taken along the lines 4—4 in FIG. 3.

As can be seen in FIG. 4, the blade 14 has only one beveled side 22, the other side of the blade 14 being flat up to the cutting edge 16. The knives that are typically used to cut lead came have blades that are beveled on both sides with the result that an essentially V-shaped notch is formed when the lead came is cut. In such a case, neither of the cut pieces has a square edge. With the blade beveled on one side only, as in the present invention, a cleaner cut is obtained and one of the cut pieces will have an essentially square edge.

Figure 2:
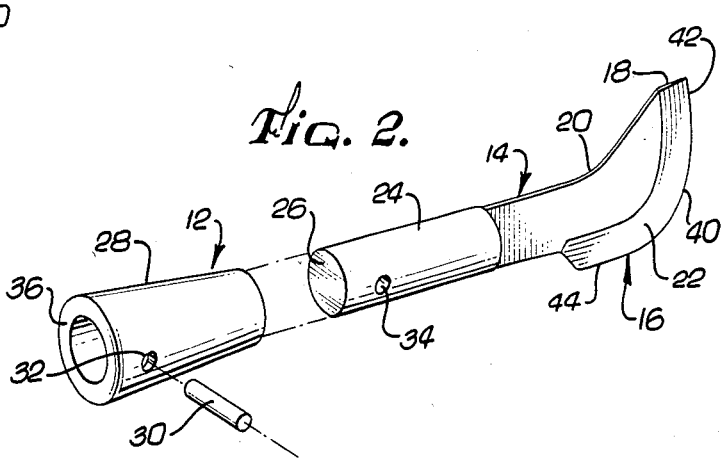
FIG. 2 is a perspective view of the preferred embodiment of the present invention shown in FIG. 1, particularly illustrating the construction of the handle portion of the tool.

Referring to FIG. 2, the blade 14 is mounted in an inner core portion 24 of the handle 12. In the preferred embodiment, this inner core portion 24 comprises an essentially cylindrical-shaped piece of heavy metal, such as lead, into one end of which the end of the blade 14 is inserted and secured. The weight provided by the inner core portion 24 to the tool 10 provides a force which assists the tool 10 in cutting pieces of lead came and also enhances the functioning of the tool 10 as a hammer.

The end 26 of the inner core portion 24 opposite to that at which the blade 14 is attached is essentially flat. The end 26 is therefore usable as a hammer, as will be described.

The outer sleeve portion 28 of the handle 12 comprises a hollow frusto-conical section sized to snuggly fit over the inner core portion 24. The outer sleeve portion 28 is secured to the inner core portion 24 of the handle 12 by means of a dowel pin 30 which slips through oppositely disposed holes 32 in the sleeve portion 28 and a through hole 34 in the inner core portion 24 when the outer sleeve portion 28 and the inner core portion 24 are properly aligned, as can be seen with reference to FIG. 4.

The outer sleeve portion 28 of the handle 12 is preferably fabricated from a firm non-metallic material such as wood, hard rubber, or plastic. The end 36 of the outer sleeve portion 28 opposite to the blade 14 forms an essentially flat annular surface. When the outer sleeve portion 28 is co-axially mounted over the inner core portion 24 and the dowel pin 30 inserted through the holes 32 and 34 to secure the outer sleeve portion 28 to the inner core portion 24, the end 36 of the outer sleeve portion 28 extends at least as far as, or slightly beyond, the end 26 of the inner core portion 24. The end portion 36 of the sleeve portion 28 is used, as will be described, to tap upon the edges of stained glass pieces in order to properly position them.

Figure 3:
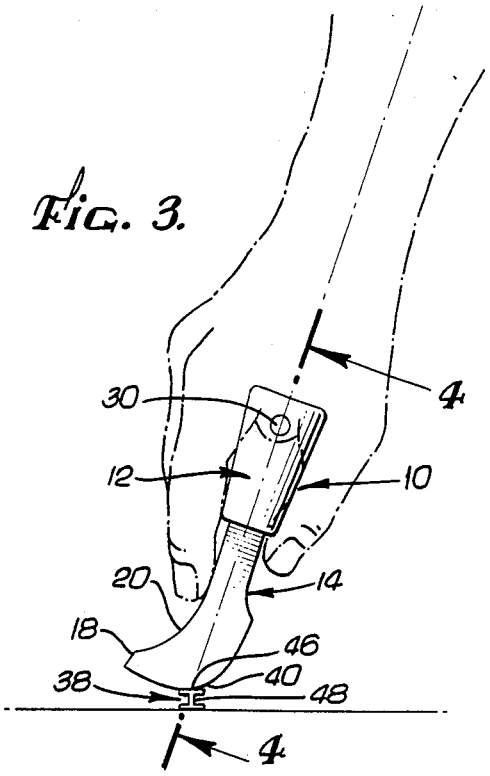
FIG. 3 shows a preferred method for using the present invention in order to cut lead came.

FIG. 3 shows the tool 10 of the present invention being used as a knife in order to cut a piece of lead came 38. It will be noticed from FIG. 3 that the tool 10 of the present invention is not grasped by the hand in the same manner that the prior art knives used to cut lead came, and indeed most other knives, are grasped. With the prior art knifes, the circumferential portion of the handle is grasped with the palm of the hand and the fingers wrapped generally circumferentially around the length of the handle. With the present invention, the handle 12 is grasped at the end 26 and 36 by the palm of the hand with the fingers of the hand running generally in a direction along the length of the handle 12 toward the blade 14. The fingers and thumb may be pressed against the side of the handle 12 with one or more fingers being placed over that end of the handle 12 at which the blade 14 is attached. The index finger may be positioned on the non-cutting edge 20 of the blade 14 in order to assist in guiding the cutting edge 16 as it cuts through the lead came 38, such as shown in FIG. 3.

As with the prior art knives, the lead came 38 is not cut by the tool 10 by sawing or slicing, but rather by exerting a downward pressure on the tool 10 and rocking and wiggling the tool 10 until the piece of lead came 38 is cut through.

While the weighted inner core portion 24 of the handle 12 assists in applying the downward force necessary to cut through the lead came 38, the cutting of the lead came 38 is enhanced even more by the structure of the tool 10 which permits it to be grasped in the manner described above. Thus, as is apparent from FIG. 3 and the above description, the wrist and the arm of the person using the tool 10 are all aligned along essentially the same line. This allows the entire force of the arm to be exerted through the wrist onto the end 36 and 26 of the tool 10 and thus on the lead came 38. In the prior art knives, the manner in which the knives are grasped by the hand do not allow the knife, the hand and wrist, and the arm to be all co-aligned. This means that ultimately the wrist must provide the entire force used for cutting the lead came 38. Hence, the present invention, in allowing the entire arm to be utilized, considerably facilitates the cutting of lead came.

The provision of both curved sections 40 and the essentially straight sections 42 and 44 on the cutting edge 16 enhances the utility of the tool 10 as a knife. For example, as shown in FIG. 3, use of the curved portion 40 of the tool 10 permits the tool 10 to contact the H-section lead came 38 at essentially a point on the crown portion 46 directly above the heart portion 48 of the lead came. Where an angled cut is to be made with respect to the length of the lead came 38, it is desirable to use a part of the curved portion 40 of the cutting edge 16 having an even smaller radius of curvature in order to minimize the initial amount of contact between the cutting edge 16 and the lead came 38 and to thereby minimize the possibility that the adjacent crown sections 46 of the H-section lead came will collapse while the cut is being made. Similarly, the straighter portions 42 and 44 of the cutting edge 16 are advantageously used in making other types of cuts in H-section lead came and in cutting other types of lead sections used in stained glass window construction.

The present invention can perform the functions of the lathkin and hammer that are used to tap the pieces of stained glass tightly into position in the lead came channels during the construction of a stained glass window. The lathkin is a small piece of wood having essentially parallel ends. One end is placed against the edge of the glass piece while a hammer is used to hit the other end of the lathkin. The lathkin transmits the force of the hammer to the edge of the glass piece in order to tightly position the glass piece within the lead came channels without exposing the edge of the glass piece in the direct impact of the metallic end of the hammer which could cause the glass piece to break.

With the tool 10 of the present invention, the annular end 36 of the sleeve portion 28 of the handle 12 may be used to tap on the edge of the glass piece thereby tightening it into position in the lead cam channels. In normal use, the glass piece is lying against or almost against the work surface, the edge of the glass being thinner than the annular end 36 of the sleeve portion 28 so that the tool 10 may be slid back and forth on the work surface against the edge of the glass piece and contact the glass piece only along the end 36 of the sleeve portion 28 and not along the end 26 of the metallic inner core portion 24. Alternatively the end 36 of the sleeve portion 28 may extend slightly beyond the end 26 of the inner core portion 24 to minimize the possibility of contact between the end 26 of the inner core portion 24 and the edge of the glass piece. The necessary force is provided in part by the weighted inner core portion 24 of the handle 12 which does not itself make direct contact with the edge of the glass piece.

Nails may be hammered into the horizontal work surface using the tool 10 of the present invention by holding it with its blade upward and using the end 26 of the inner core portion 24 to repetitively strike the heads of the nails. These nails, which are hammered in only part of the way, must be removed and be inserted many times as the construction of the stained glass window proceeds. Removal of the partially hammered in nails is also easily accomplished with the present invention. A portion of the non-cutting edge 20 of the blade 14 near the tip 18 is placed beneath the head of the nail to be removed. The tool 10 is rested on the work surface on its cutting edge 16 with the blade 14 oriented perpendicular to the work surface. The tool 10 is then pivoted on its cutting edge 16 in order to lift the tip 18 and hence the nail away from the work surface. Because the nails are only partially hammered into the work surface and the work surface is wood or plywood, there is no significant adverse effect on the blade 16 or the work surface from this action.

Over a period of time, the tapping of the edge of glass pieces with the end 36 of the sleeve portion 28 of the handle 12 may eventually cause the sleeve portion 28 to wear out or deteriorate at its end 36. With the present invention, however, a new sleeve portion 28 may be simply and quickly inserted merely by removing the dowel pin 30 from the holes 32 and 34 in the sleeve and inner core portions 24 and 28, respectively, of the handle 12 and slipping the worn out or deteriorated sleeve portion 28 off of the inner core portion 24. A new sleeve portion 28 may then be co-axially slipped over the inner core portion 24, the holes 32 and 34 aligned and a dowel pin 30 inserted to secure the replacement sleeve portion 28 to the inner core portion 24.

While the present invention has been described in terms of a presently preferred embodiment, other configurations and variations are within the scope of the present invention. For example, the handle of the tool could be an extruded aluminum member. While the tool then would perhaps have less utility as a hammer, its utility as a knife and in removing nails would be unimpaired. Thus, it is intended that the claims not be limited to the specific preferred embodiment discussed herein.

I claim:

1. A tool for cutting lead came or the like comprising a short straight handle member having a first and second end and a blade member attached at one end to the first end of said handle member, said handle member and said blade member being oriented in the same direction parallel to a line through the center of said handle, said blade member having a convex cutting edge on its end opposite to said handle member, said convex cutting edge comprising a curved portion forming a sharply rounded corner and relatively straight portions on each side of said corner, one said relatively straight portion at the end of said blade member facing generally away from said handle member and oriented in a direction generally perpendicular to said line through the center of said-handle and the other said straight portion facing generally away from said line through the center of said handle and oriented in a direction generally parallel to said line through the center of said handle, the line through the center of said handle member intersecting said cutting edge near near the sharply rounded corner, the second end of said handle member for grasping in the palm of the hand of the user, with the fingers of the user extending generally along said handle member, so that a force is exerted by the arm and hand in a direction along said handle member and blade member in order to cut a portion of lead came placed against said cutting edge near the sharply rounded corner.

2. A multipurpose tool for use in constructing stained glass windows comprising:

a short handle having a first and second end; and a blade having a first end attached to the second end of said handle, the length of the shaft of said blade being oriented in the direction along the length of said handle, said blade having an arcuate convex cutting edge at its second end forming an essentially rounded corner with relatively straight sides, one said side of the corner extending parallel to the shaft of said blade on one side of said shaft and the other side extending generally perpendicular to the shaft of said blade on the other side of said shaft, the edge of said blade opposite said cutting edge being concave so that a nail partially hammered into a surface can be received by placement of said concave edge beneath the head of the nail and the pivoting of said blade about said rounded corner on said surface.

3. A tool as in claim 2 wherein said short handle comprises a weighted core portion along its length and a sleeve portion surrounding said core portion along its length, the first end of said handle having said core portion exposed for use in hammering small nails used in stained glass window construction, said sleeve portion extending toward said end at least as far as said core portion, the end of said sleeve portion being usable for safely tapping edges of stained glass pieces into position in lead came channels.

4. A tool as in claims 1, 2, or 3 wherein said cutting edge is beveled on one side only.

5. A tool as in claim 1 where said short handle member comprises a weighted metal core portion, said core portion having a surface at the second end of said short handle member exposed for use in hammering small nails.

6. A tool as in claim 1 wherein the edge of said blade member opposite to said cutting edge is concave so that nails partially hammered into a surface may be removed by placement of the nail head under said concave edge and -by pivoting said blade member about said rounded corner by moving said handle toward said surface.

7. A tool as in claim 5 further comprising a sleeve portion surrounding the sides of said core portion and, at the second end of said handle member, extending at least as far as said core member, the end of said sleeve member at said second end being usable to tap stained glass pieces into position into lead came channels.

8. A tool as in claim 6 wherein said blade has a blunt tip between the end of the cutting edge adjacent to the straight section facing generally away from said handle member and said concave edge.

9. A tool as in claim 1 wherein said handle member is so constructed to be of a length to enable a user to grasp said tool with the central portion of the palm of the user's hand placed over said second end while the user's fingers are extended over and beyond said first end.

10. A tool as in claim 2 wherein said handle is so constructed to be of a length to enable a user to grasp said tool with the central portion of the palm of the user's hand placed over said first end while the user's fingers are extended over and beyond said second end.

* * * * *